US006907648B2

(12) United States Patent
Eldessouky

(10) Patent No.: US 6,907,648 B2
(45) Date of Patent: Jun. 21, 2005

(54) RIVETING TOOL SUCH AS A NUT PLATE RIVETER

(75) Inventor: Ahmed Eldessouky, Pico Rivera, CA (US)

(73) Assignee: Textron Inc., Providence, RI (US)

( * ) Notice: Subject to any disclaimer, the term of this patent is extended or adjusted under 35 U.S.C. 154(b) by 0 days.

(21) Appl. No.: 10/731,219

(22) Filed: Dec. 9, 2003

(65) Prior Publication Data

US 2004/0139590 A1 Jul. 22, 2004

Related U.S. Application Data

(60) Provisional application No. 60/441,565, filed on Jan. 21, 2003.

(51) Int. Cl.[7] ..... B21J 15/20

(52) U.S. Cl. ..... 29/243.525; 29/243.523; 72/453.17

(58) Field of Search ..... 72/453.17, 391.2, 72/391.4; 29/243.523, 243.525

(56) References Cited

U.S. PATENT DOCUMENTS

| | | | | |
|---|---|---|---|---|
| 3,457,763 A | * | 7/1969 | Freeman | 29/243.525 |
| 3,523,441 A | * | 8/1970 | Bell et al. | 29/243.525 |
| 3,557,597 A | | 1/1971 | Heslop et al. | |
| 3,714,810 A | * | 2/1973 | Boyd | 29/243.525 |
| 4,059,980 A | | 11/1977 | Nance | |
| 4,143,580 A | | 3/1979 | Luhm | |
| 4,219,924 A | | 9/1980 | Luhm | |
| 4,259,858 A | | 4/1981 | Freeman et al. | |
| 4,407,619 A | | 10/1983 | Siebol | |
| 4,552,010 A | | 11/1985 | Hein | |
| 6,267,684 B1 | | 7/2001 | Luhm | |

OTHER PUBLICATIONS

Product manual for the G746A tool, Textron Aerospace Fasteners, 1997.
Product manual for the G747 tool, Textron Aerospace Fasteners, 1998.
Product manual for the G704B tool, Textron Aerospace Fasteners, 1998.

* cited by examiner

*Primary Examiner*—David Jones
(74) *Attorney, Agent, or Firm*—Trexler, Bushnell, Giangiorgi, Blackstone & Marr, Ltd

(57) ABSTRACT

A nut-plate riveter which includes multiple pistons which assist in creating a pulling force. The nut-plate riveter provides that spent mandrels are pulled through the tool, thereby avoiding problems in the field. The nut-plate riveter includes a handle and a plurality of pistons disposed in the handle. Cavities are proximate the pistons for pressurizing the pistons, and air supply passages are in communication with the cavities for supplying air to the cavities to pressurize the pistons. A piston rod is engaged with at least one of the pistons, and the piston rod has a longitudinal bore therethrough which is configured to receive a spent mandrel. A deflector fitting may be disposed at an end of the nut-plate riveter.

13 Claims, 11 Drawing Sheets

RIVETING TOOL SUCH AS A NUT PLATE RIVETER

RELATED APPLICATION (PRIORITY CLAIM)

This application claims the benifit of U.S. Provisional Application Ser. No. 60/441,565, filed Jan. 21, 2003.

BACKGROUND

This invention generally relates to tools for installing nut-plate rivets, and more specifically relates to a nut-plate riveter which includes multiple pistons in a feed-through mandrel design.

Tools are used to install nut-plate rivets. It is advantageous to provide that such tools are lightweight, yet provide the required pulling force on a mandrel for installing a nut-plate rivet. It is also advantageous to provide that such tools are easy to assemble, use and maintain.

Many of the tools which are presently commercially available are pneumatic and provide that air pushes a piston in the tool in order to provide the required pulling force on a mandrel which pulls through the rivet. At least one of the tools which is available provides that a plurality of pistons are disposed in the tool, and the plurality of pistons assist (viz-a-viz the air supply) in providing the pulling force. By providing a plurality of pistons, less air pressure is needed to produce the requisite pulling force.

Although there is at least one tool presently available which includes multiple pistons, the tool is not configured such that a spent mandrel is automatically pulled through the tool (i.e., away from the nose of the tool). Providing that the spent mandrel is pulled through the tool is advantageous because, otherwise, the spent mandrel must drop out of the front of the tool, and this presents problems. Among other problems, such a design may lead to FOD (Foreign Object Debris) problems in the field, wherein contaminants enter the tool through the front end of the tool, causing the tool to jam, misfunction or break.

OBJECTS AND SUMMARY

An object of an embodiment of the present invention is provide a nut-plate riveter which is lightweight.

Another object of an embodiment of the present invention is provide a nut-plate riveter which is easy to assemble, use and maintain.

Yet another object of an embodiment of the present invention is provide a nut-plate riveter which includes a plurality of pistons which assist (viz-a-viz the air supply) in providing a pulling force.

Still yet another object of an embodiment of the present invention is provide a nut-plate riveter which includes multiple pistons in a feed-through mandrel design.

Briefly, and in accordance with at least one of the foregoing objects, an embodiment of the present invention provides a nut-plate riveter which includes multiple pistons which assist in creating a pulling force. The nut-plate riveter provides that spent mandrels are pulled through the tool, thereby avoiding problems in the field. The nut-plate riveter includes a handle and a plurality of pistons disposed in the handle. Cavities are proximate the pistons for pressurizing the pistons, and air supply passages are in communication with the cavities for supplying air to the cavities to pressurize the pistons. A piston rod is engaged with at least one of the pistons, and the piston rod has a longitudinal bore therethrough which is configured to receive a spent mandrel. A deflector fitting may be disposed at an end of the nut-plate riveter.

BRIEF DESCRIPTION OF THE DRAWINGS

The organization and manner of the structure and operation of the invention, together with further objects and advantages thereof, may best be understood by reference to the following description, taken in connection with the accompanying drawings, wherein like reference numerals identify like elements in which.

DESCRIPTION

Figure 1:
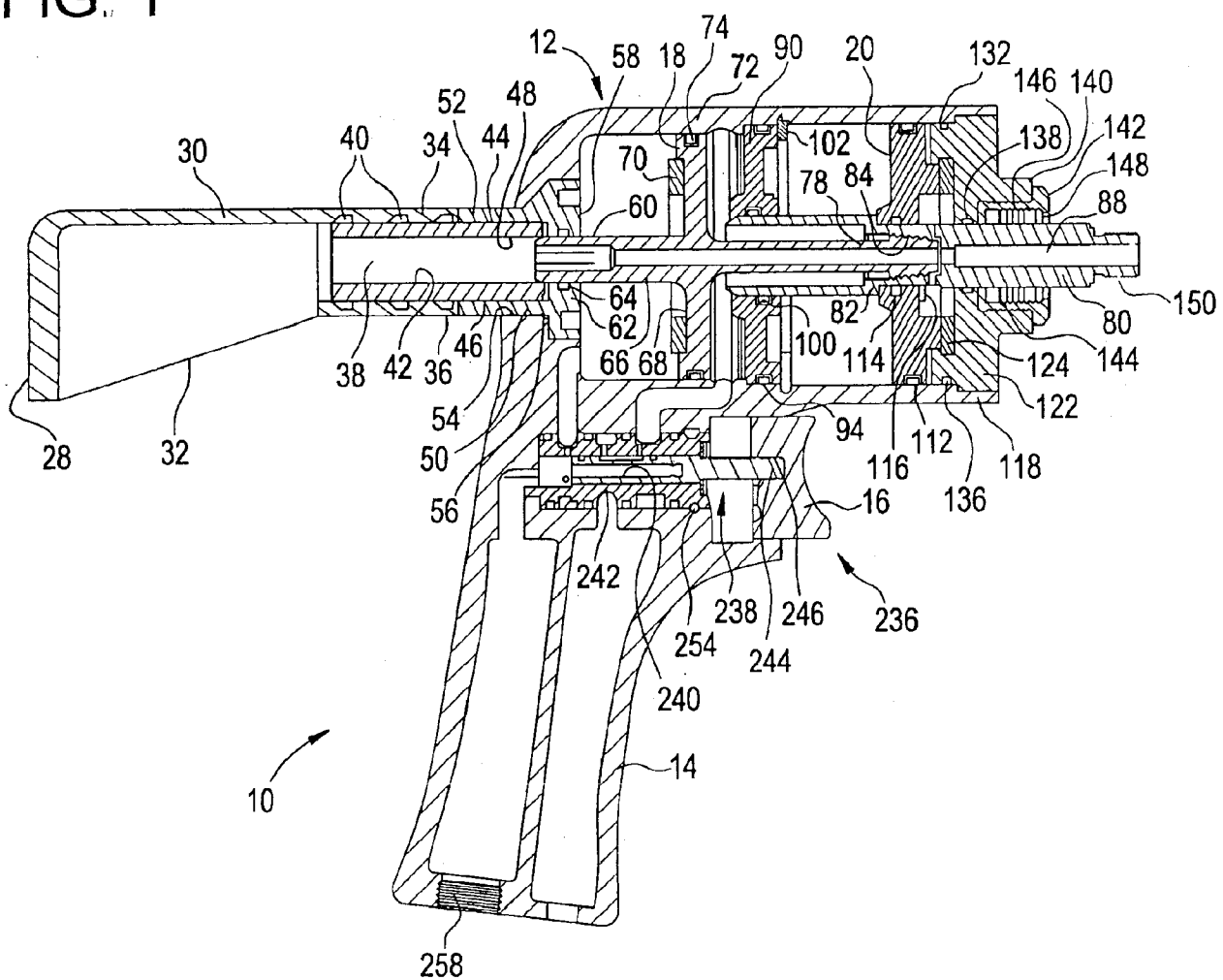
FIG. 1 is a cross-sectional view of a nut-plate riveter which is in accordance with an embodiment of the present invention, wherein the nut-plate riveter includes two pistons in a pull-through mandrel design.

While the present invention may be susceptible to embodiment in different forms, there are shown in the drawings, and herein will be described in detail, embodiments thereof with the understanding that the present description is to be considered an exemplification of the principles of the invention and is not intended to limit the invention to that as illustrated and described herein.

Figure 2:
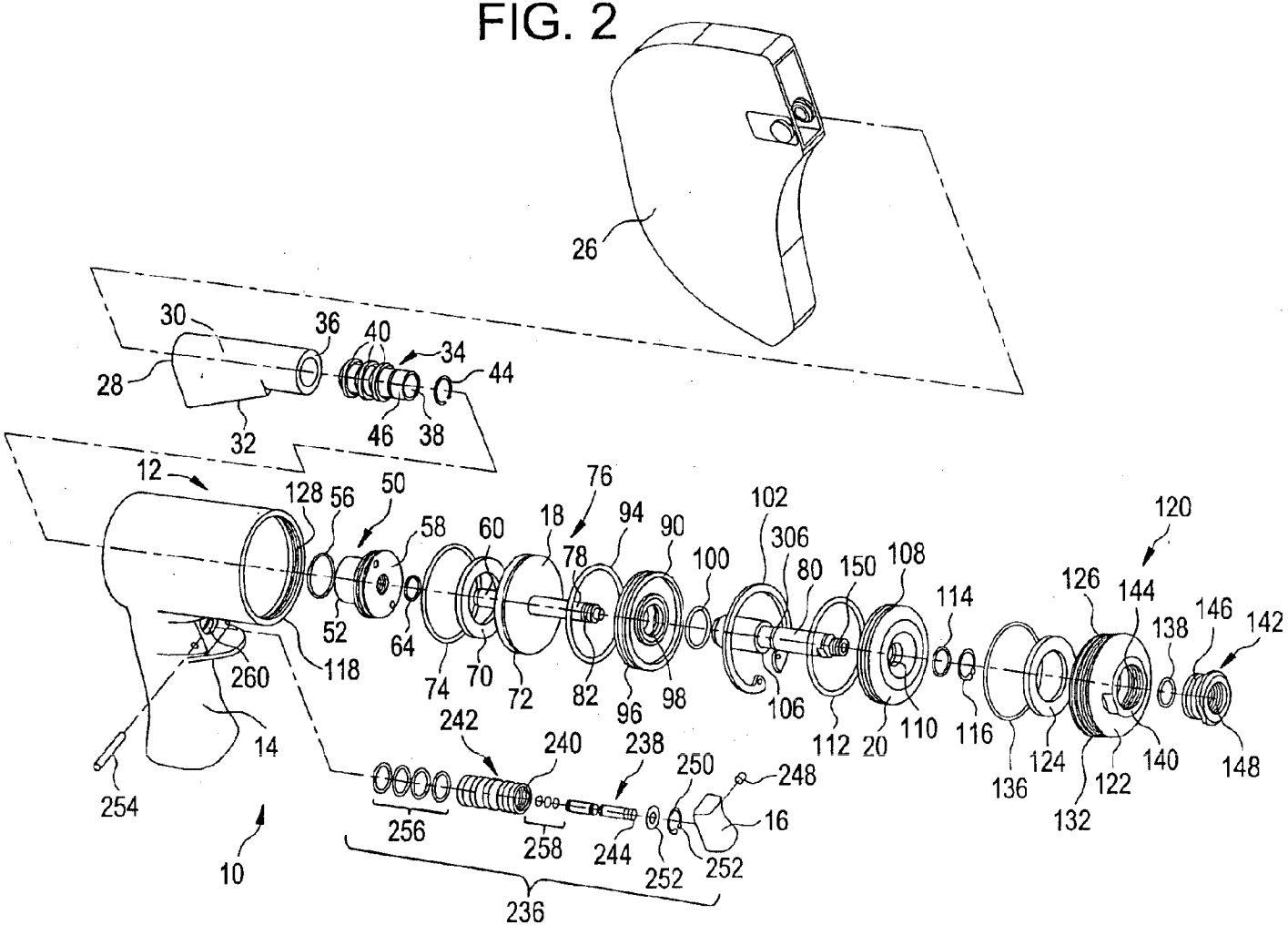
FIG. 2 is an exploded, perspective view of the nut-plate riveter shown in FIG. 1.
Figure 3:
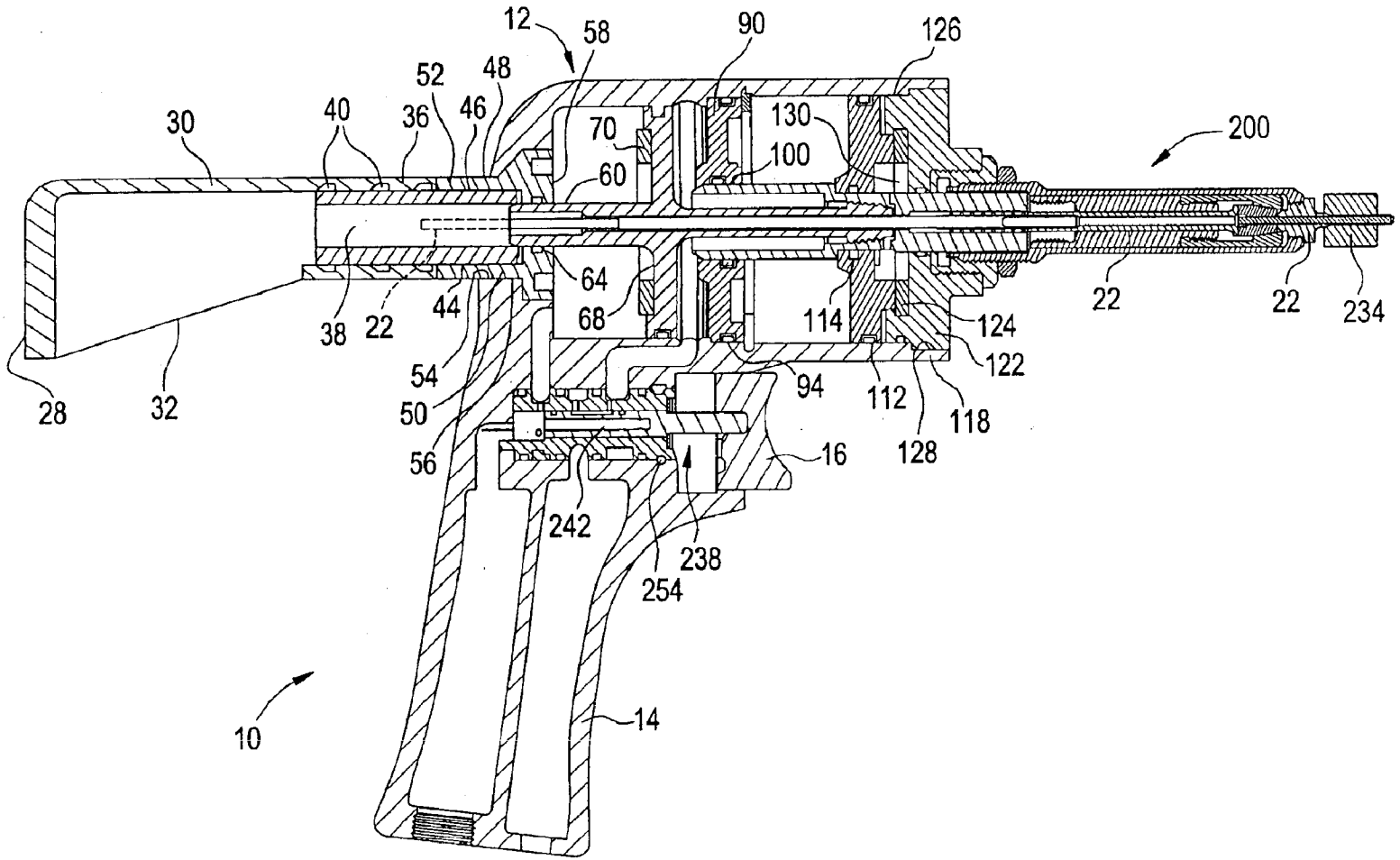
FIG. 3 is a cross-sectional view of the nut-plate riveter shown in FIG. 1, shown in stand-by position, connected to a pulling head.
Figure 15:
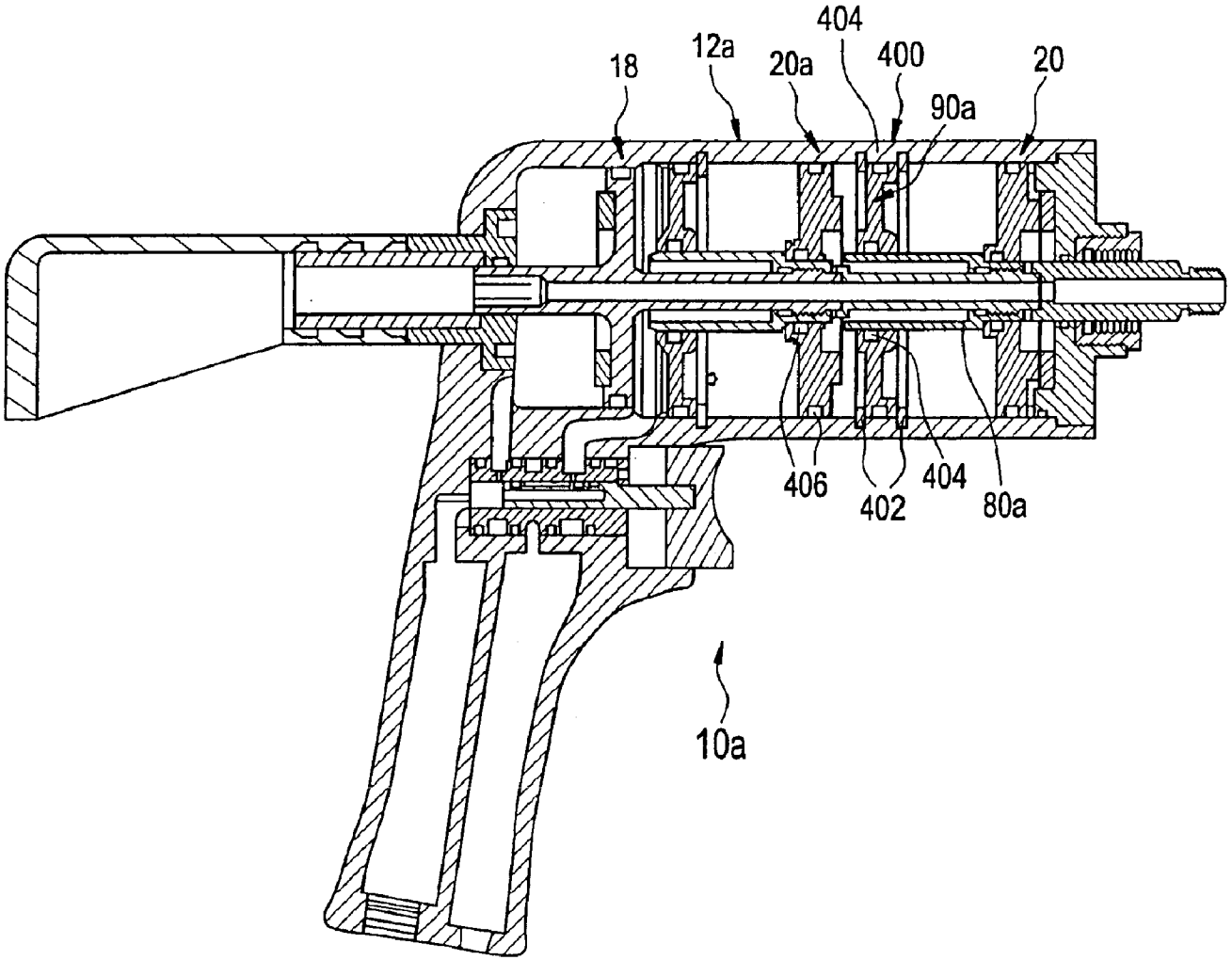
FIG. 15 is a cross-sectional view of a nut-plate riveter which is in accordance with another embodiment of the present invention, wherein the nut-plate riveter includes three pistons in a pull-through mandrel design.

FIGS. 1–3 illustrate a nut-plate riveter 10 which is in accordance with a first embodiment of the present invention, wherein the nut-plate riveter 10 includes two pistons in a pull-through mandrel design, while FIG. 15 illustrates a nut-plate riveter 10*a* which is in accordance with a second embodiment of the present invention, wherein the nut-plate riveter 10*a* includes three pistons in a pull-through mandrel design. Regardless of how many pistons are employed, the fact that multiple pistons are used provides that the tool can be lightweight, yet provide the requisite pulling force on a mandrel to install a rivet. Further, the fact that the spent mandrel is pulled through the tool avoids problems and provides that the tool is reliable.

The nut-plate riveter 10 illustrated in FIGS. 1–3 will be described first, and then the nut-plate riveter 10*a* illustrated in FIG. 15 will be described, pointing out the differences between the two designs, and using like reference numerals to identify like parts.

As shown in FIGS. 1–3, the nut-plate riveter 10 includes a handle 12 which includes a portion 14 which is configured to be held by a user. A trigger 16 is proximate the handle portion 14 for pressing by the user to actuate the nut-plate riveter 10. Two pistons 18 and 20 are disposed in the handle 12, and they are spaced apart from each other. As will be described in more detail below, when the nut-plate riveter 10 is actuated, air pushes on the two pistons 18 and 20 to produce a pulling force on a mandrel 22 (see FIG. 4), thereby installing a nut-plate rivet 24.

Starting from the rear of the nut-plate riveter 10 and going forward, the nut-plate riveter 10 includes a mandrel collector bag 26 (see FIG. 2) for collecting spent mandrels which are ejected from the rear of the tool 10. The mandrel collector bag 26 is configured to fit onto the end 28 of a pin deflector 30. The pin deflector 30 is generally hollow and has an opening 32 which communicates with the interior of the mandrel collector bag 26 such that spent mandrels 22 can drop from the pin deflector 30, through the opening 32, into the mandrel collector bag 26.

A deflector fitting 34 is configured to engage an opposite end 36 of the pin deflector 30. Specifically, the deflector fitting 34 is generally hollow and cylindrical having a throughbore 38, and includes a serration or ribs 40 which engage an interior surface 42 of the pin deflector 30.

A retaining ring 44 engages the exterior surface 46 of the deflector fitting 34 as well as engages the interior surface 48 of a rear plug 50. The rear plug 50 is generally retained in the handle 12 and has an end portion 52 which extends from an aperture 54 in the handle 12 and engages the deflector fitting 34. A sealing member or o-ring 56 engages an exterior surface of the rear plug 50 and an interior surface of the handle 12. The rear plug 50 has an end 58 which is configured to receive an end 60 of the rear piston. Proximate the end 58 is a groove 62 for receiving a retaining member or o-ring 64. The rear piston 18 has a central throughbore 66 along its longitudinal axis. The rear piston 18 includes a groove 68 for receiving a rubber bumper 70 as well as includes a groove 72 for receiving a retaining member or o-ring 74 where the retaining member or o-ring 74 engages an interior surface of the handle 12. The rubber bumper 70 and rear piston 18 together comprise a rear piston sub-assembly 76.

An end 78 of the rear piston 18 is configured to engage a piston rod 80. Specifically, as shown, preferably the end 78 of the rear piston 18 includes external threads 82 which threadably engage corresponding internal threads 84 in the piston rod 80. As shown in FIG. 6, the threads 82 are interrupted such that two grooves 86 are provided, thereby providing air passages. The piston rod 80 is generally cylindrical having a central throughbore 88 along its longitudinal axis, and includes orifices 306 which allow the passage of air. A bulkhead 90 engages the exterior surface of the piston rod 80 and contacts a wall 92 (see FIG. 5) in the handle 12. A retaining member or o-ring 94 is disposed in a groove 96 in the bulkhead 90, generally between the bulkhead 90 and the piston rod 80. The bulkhead 90 includes a second groove 98, and a retaining member or o-ring 100 is disposed in the second groove 98, disposed generally between the bulkhead 90 and the interior surface of the handle 12. A retaining ring 102 is disposed in the handle, engaged in a groove 104 provided on the interior surface of the handle 12.

The front piston 20 engages the piston rod 80 (and specifically a wall 106 thereon) and includes grooves 108, 110 for receiving retaining members or O-rings 112, 114—a first retaining member or o-ring 112 is disposed between the front piston 20 and the interior surface of the handle 12, and a second retaining member or o-ring 114 is disposed between the front piston 20 and the piston rod 80. A retaining ring 116 engages an exterior surface of the piston rod 80.

An end 118 of the handle 12 is configured to receive a front cap sub-assembly 120 which consists of a front cap 122 and rubber bumper 124. Specifically, the front cap 122 has external threads 126 which are configured to threadably engage corresponding internal threads 128 on the interior surface of the handle 12, proximate its front end 118. The front cap 122 includes a groove 130, and the rubber bumper 124 is disposed in the groove 130. The front cap 122 also includes grooves 132, 134 for receiving retaining members or o-rings 136, 138—a first retaining member or o-ring 136 is disposed in groove 132 and is disposed generally between the front cap 122 and the interior surface of the handle 12, and a second retaining member or o-ring 138 is disposed in a groove 134 and is disposed generally between the front cap 122 and the piston rod 80.

An end 140 of the front cap 122 is configured to engage a nose fitting 142. Specifically, the front cap 122 includes internal threads 144 which are configured to threadably engage corresponding external threads 146 on the nose fitting 142. The nose fitting 142 also includes internal threads 148, and the piston rod 80 includes external threads 150, for engaging a pulling head 200.

One form of pulling head 200 which can be used in connection with the riveter 10 is shown in, primarily, FIGS. 3 and 10–14. As shown, the pulling head 200 includes a sleeve 202 which has corresponding external threads 204 thereon configured to threadably engage the internal threads 148 of the nose fitting 142. A locknut 206 is disposed on the external threads 204 on the sleeve 202. A drawbar 208 is disposed in the sleeve 202. The drawbar 208 has internal threads 210 which are configured to threadably engage the corresponding external threads 150 on the piston rod 80, and has external threads 212 for threadably engaging corresponding internal threads 214 which are provided in a collet 216. A jaw follower sub-assembly 218 is disposed generally in the drawbar 208, and the jaw follower sub-assembly 218 contactably engages a jaw set 220 which engages and pulls on the mandrel 22 during actuation of the riveter 10. The collet 216 includes an angled cavity 221 therein proximate the jaw set 220. An end of the jaw follower sub-assembly 220 engages a follower spring 222, and an end 224 of the follower spring 222 engages an interior surface of the piston rod 80 (see FIG. 7). An end 226 of the sleeve 202 provides internal threads 228 which threadably engage corresponding external threads 230 on a nosepiece 232. FIGS. 3, 4 and 10–14 illustrate a test coupon 234 which represents a workpiece.

As discussed above, the nut-plate riveter 10 includes a trigger 16. The trigger 16 is a component of a trigger assembly 236 which includes a valve stem 238 which is received in a bore 240 provided in a valve sleeve 242. As will be described below when operation of the riveter is discussed, the valve stem includes a plurality of orifices for allowing air flow. An end 244 of the valve stem 242 is received in a corresponding groove 246 in the trigger 16, and the trigger 16 is secured to the valve stem 238 with a set screw 248. An opposite end of the valve stem 238 is disposed in the valve sleeve 242. The valve stem 238 is generally retained in the valve sleeve 242 by a retaining ring 250 and retaining washer 252 which engage the valve sleeve 242. A pin 254 engages the exterior surface of the valve sleeve 242. A plurality of retaining members or o-rings 256 are disposed on an exterior surface of the valve sleeve 242, generally between the valve sleeve 242 and an interior surface of the handle 12. Additionally, a plurality of retaining members or o-rings 258 are disposed on an exterior surface of the valve stem 238, generally between the valve stem 238 and an interior surface of the valve sleeve 242. The handle 12 is configured to receive an air fitting, such as viz-a-viz internal threads 258 which threadably engage corresponding external threads on the air fitting, and inside the handle are channels or cavities which allow air to flow internally through the riveter 10.

To assemble the nut-plate riveter, retaining members or o-rings 56, 58 are placed in the corresponding grooves on the rear plug 50. The rear plug 50 is then screwed into the handle 12 using a spanner wrench. Retaining member or o-ring 74 is then is placed into groove 72 on the rear piston 18, and the rubber bumper 70 is placed in groove 68 provided on the rear piston 18. The rear piston 18 is then threadably attached to the piston rod 80. The rear piston 18 is then inserted into the rear plug 50, which has been threadably engaged in the handle 12. Retaining member or o-rings 94, 100 are inserted into the corresponding grooves 96, 98 in the bulkhead 90. The bulkhead 90 is then inserted into the handle 12 with the piston rod 80 passing through the bulkhead 90, until the bulkhead 90 sits against wall 92 in the handle 12. The bulkhead 90 is held in place with retaining ring 102.

Retaining member or o-rings 112, 114 are placed in the corresponding grooves 108, 110 of the front piston 20, and the front piston 20 is then inserted into the handle 12 with the piston rod 80 passing through the front piston 20 until the front piston 20 rests against wall 106 on the piston rod 80. The front piston 20 is held in place with retaining ring 116. Retaining member or o-rings 136, 138 are placed in the corresponding grooves 132, 134 in the front cap 122. The rubber bumper 124 is positioned in the groove 130 provided in the front cap 122, and this forms the front cap sub-assembly 120. The front cap sub-assembly 120 is then screwed into the handle 12 until it comes to a stop, with the piston rod 80 passing through the front cap 122. The nose fitting 200 is then screwed into the front cap sub-assembly 120 until the nose fitting 200 comes to a stop. With this assembly, the piston rod 80 protrudes through the nose fitting 142 (see FIG. 1). Retaining ring 44 is placed in the corresponding groove provided on the deflector fitting 34, and the deflector fitting 34 is then inserted into the rear of the handle 12, through the rear plug 50 until the retaining ring 44 snaps into place at the corresponding groove provided in the rear plug 50. The deflector fitting 34 is inserted into the pin deflector 30 so that the serration 40 on the deflector fitting 34 arrests the pin deflector 30. The mandrel collector bag 26 is then placed over the pin deflector 30 and snapped into place.

With regard to assembling the trigger assembly 236, the retaining members or o-rings 256, 258 are placed in the corresponding grooves provided in the valve sleeve 242 and valve stem 238. The valve stem 238 is then inserted into the valve sleeve 242 with the one end of the valve stem 238 protruding from the valve sleeve 242. The retaining washer 252 and retaining ring 250 are then inserted in the groove provided in the valve sleeve 242 to restrain the valve stem 238 and hold it in place. The assembled valve is then inserted a corresponding hole 260 provided in the handle 12 and the assembled valve is secured by pin 254. The protruding end 244 of the valve stem 238 is inserted into a recess 246 provided in the trigger 16 and is held in place by a set screw 248. Finally, an appropriate air fitting is screwed into the handle 12 (at 258).

Figure 4:
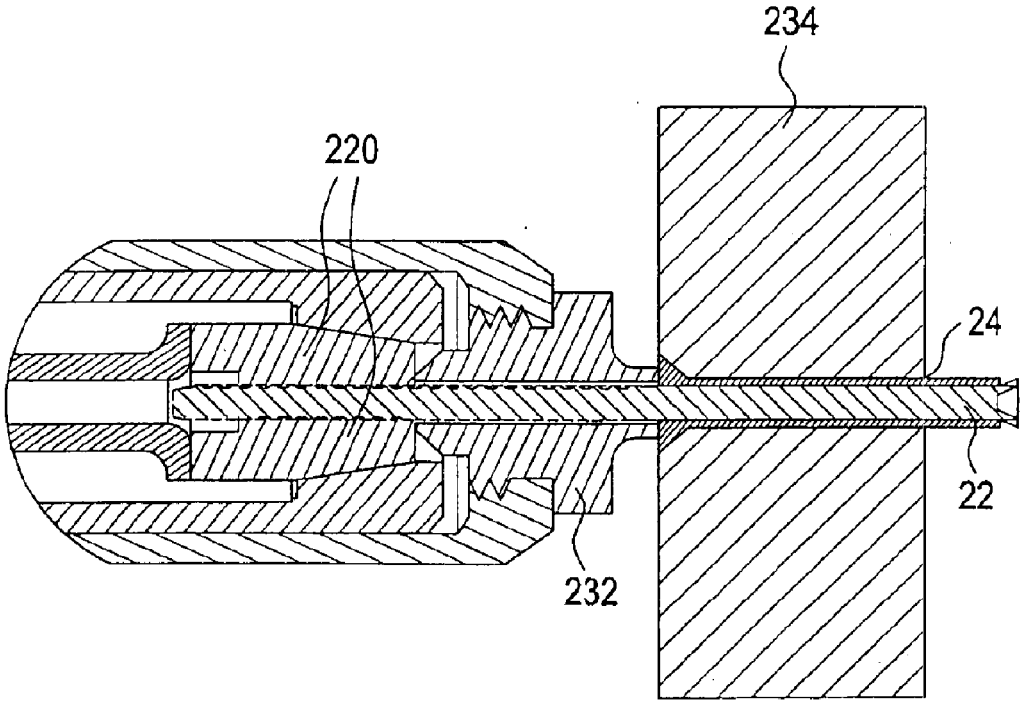
FIG. 4 is an enlarged view of a portion of that which is shown in FIG. 3.

In operation, when pressurized air is introduced at cavity 300 (see FIG. 5), the air travels through cavity 302 in the piston rod 80 and escapes into cavity 304 through orifice 306. This pressurizes both the front piston 20 and rear piston 18. The air pressure then causes movement of both pistons backwards with amplified force due to the multiple piston arrangement. The pressurized air is trapped in the respective cavities with the appropriate arrangements of o-ring seals. While the pistons 18 and 20 are moving, the air in cavity 308 is vented through orifice 310 in the handle 12. As shown in FIG. 9, simultaneously, air from cavity 310 at the back of the rear piston 18 is routed through cavity 312 to the annulus 314 (see FIG. 8) on the trigger valve and vented through orifice 316 to atmosphere. It is the movement of the multiple pistons that provides the operational force of the tool 10. As shown in FIGS. 3 and 4, the operation swags a collar 24 against a work piece (represented by coupon 234) while pulling on a mandrel 22 until the mandrel 22 experiences tensile failure. The spent mandrel 22 is then propelled down the center of the multiple piston arrangements towards the rear of the housing 12 into the collecting bag 26. The position shown in FIG. 7 is with the pistons 18 and 20 in the extreme back position.

Figure 8:
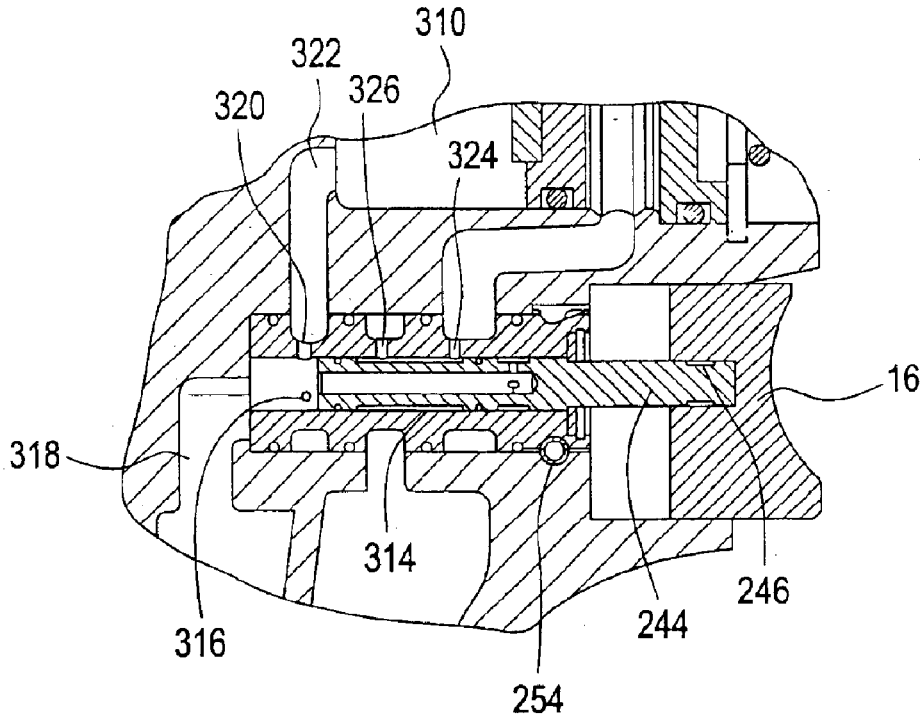
FIG. 8 is an enlarged view of a portion of that which is shown in FIG. 3, specifically showing a trigger assembly portion in the standby position.
Figure 9:
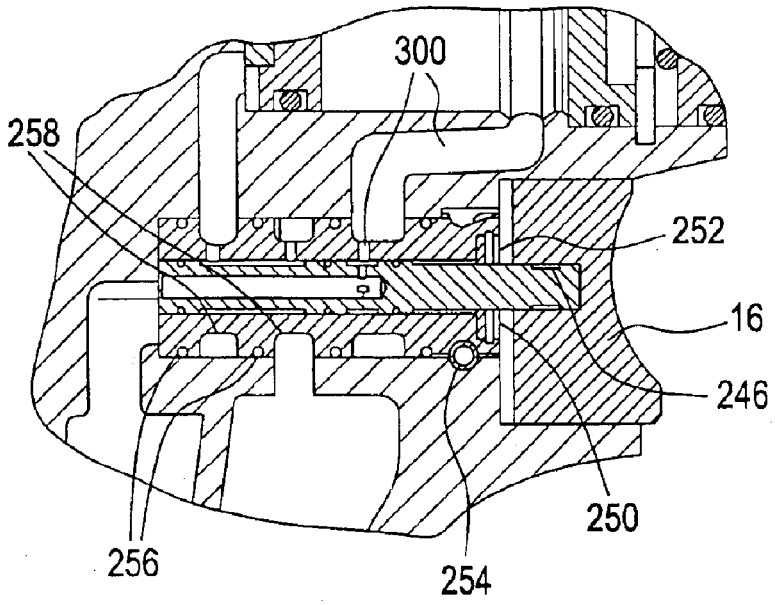
FIG. 9 is a view similar to FIG. 8, but showing the trigger depressed.

With reference to FIG. 8, upon release of the trigger 16, air pressure at cavity 318 pushes the trigger valve outwards and air is introduced into the back of the rear piston 18 through orifice 320 into cavity 322. Cavity 300 is vented by a connection to atmosphere through the orifice 324 and annulus 314 whereby annulus 314 makes the connection between orifice 324 and atmosphere via orifice 326. Air is allowed to enter into cavity 308 (see FIG. 5) through orifice 310 so that a vacuum will not be formed behind the front piston 20. In this way, only the rear piston 18 returns the multiple piston arrangement to the standby position ready for activation.

Figure 5:
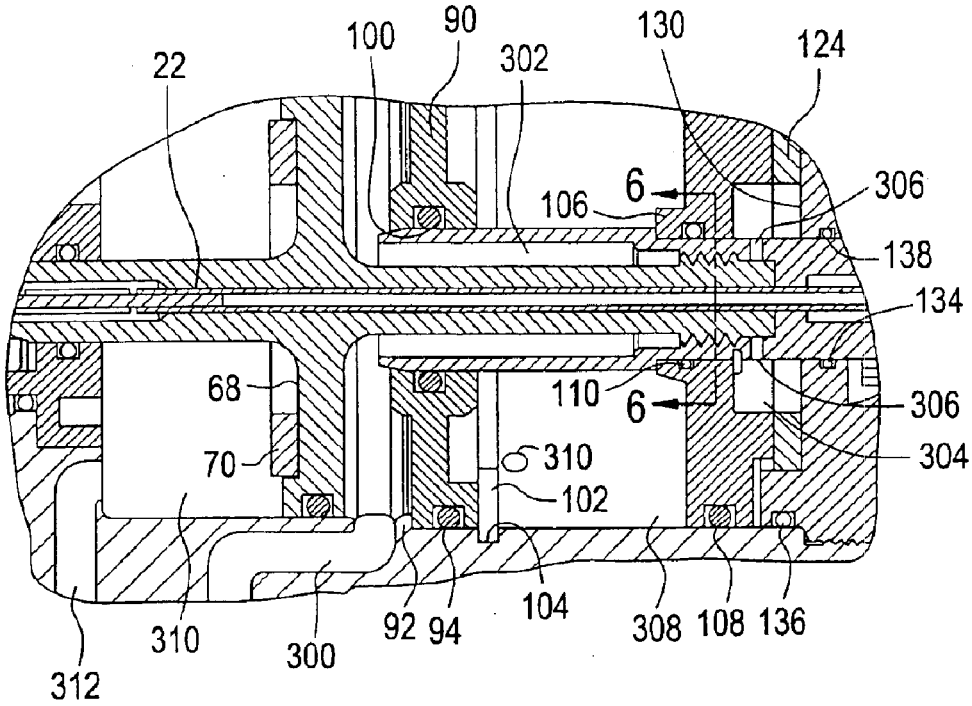
FIG. 5 is an enlarged view of another portion of that which is shown in FIG. 3.
Figure 6:
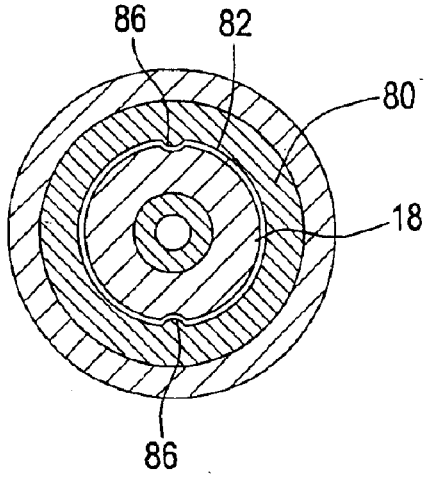
FIG. 6 is a cross-sectional view taken along line 6—6 of FIG. 5.
Figure 7:
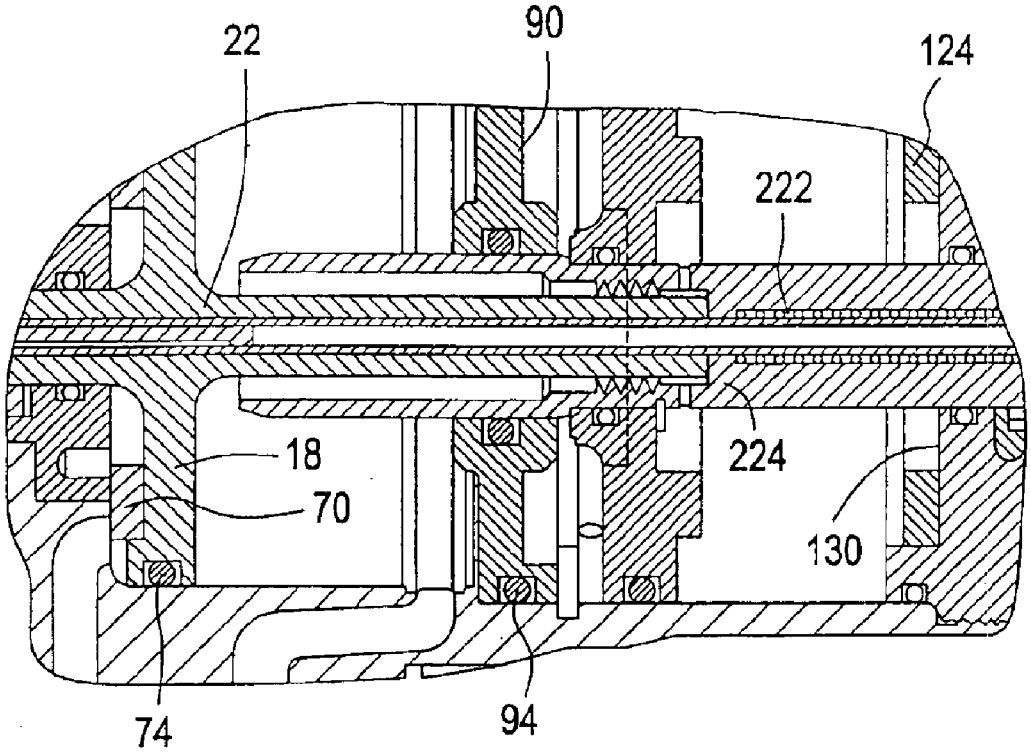
FIG. 7 is similar to FIG. 5, but showing the situation when the tool is activated (in the rear position), and showing the spent mandrel.

As can be seen from FIGS. 5 and 7, the spent mandrel 22 from the swaging operation is allowed to travel through the center of both the front and rear pistons 18, 20 to the collector bag 26, without interfering with the pressurized air that routed around the piston shafts.

Figure 10:
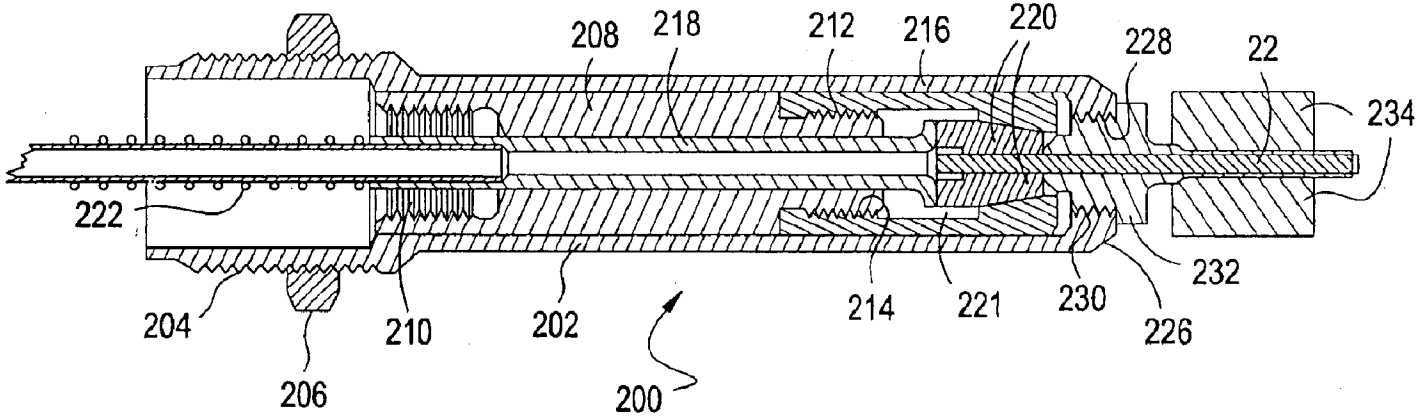
FIGS. 10–14 are sequential views showing operation of the pulling head during actuation of the nut-plate riveter.
Figure 11:
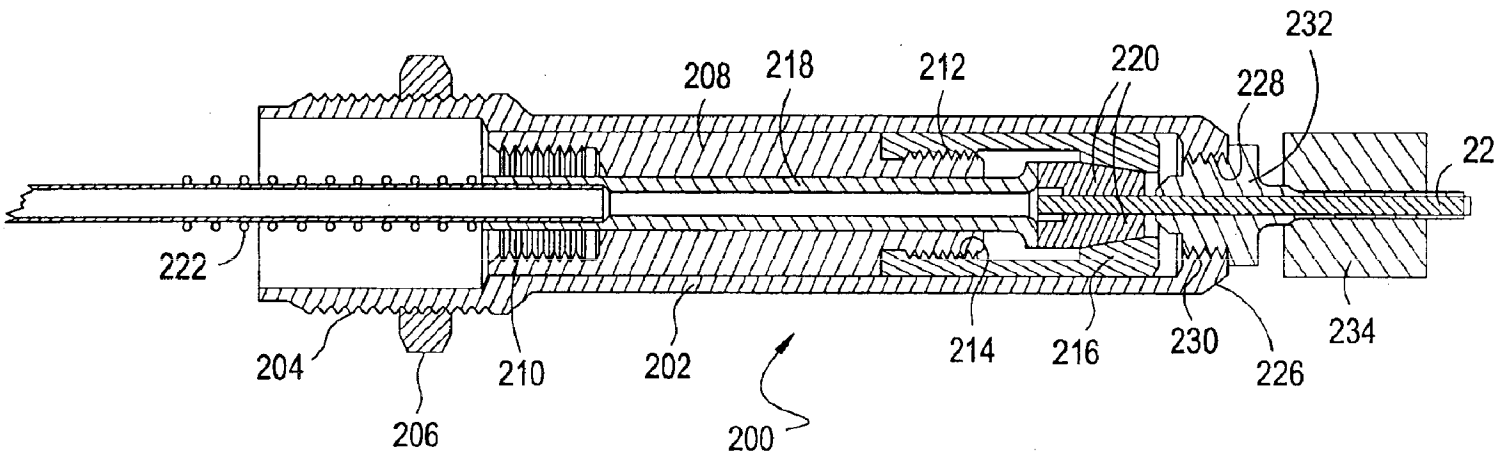
Figure 12:
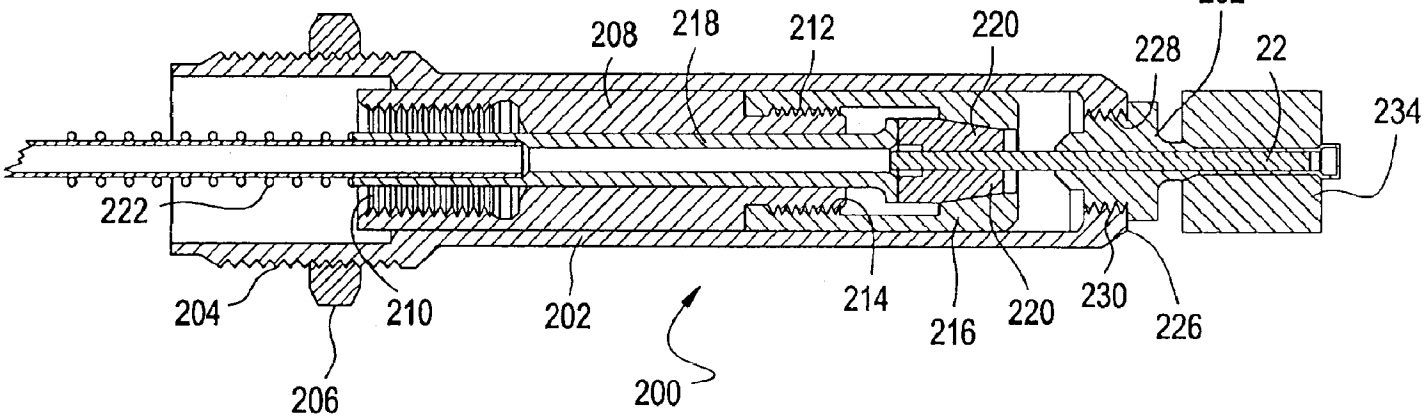

Actuation of the pulling head 200 during operation of the riveter 10 is best shown in the sequence of view provided in FIGS. 10–14. Because the jaw follower sub-assembly 218 is loaded by spring 222, the nosepiece 232 causes the jaw set 220 to expand in the collet 216, with each jaw in the two-jaw set maintaining contact with the angled cavity 221 in the front of the collet 216. With the jaw set 220 expanded, a nut-plate rivet 24 can be inserted into the nosepiece 232 (or removed) with no resistance. The rivet 24 can then be inserted into the materials to be fastened (represented by coupon 234). When the trigger 16 is pulled, the front piston rod 80 begins to retract, and the drawbar 208 and collet 216 move away from the nosepiece 232, which remains stationary in the sleeve 202. The jaw set 220 is pushed forward in the collet,216 and closes until it clamps onto the mandrel 22. FIG. 10 shows the situation as the jaws 220 have just made contact with the mandrel 22. The angled cavity 221 in the collet 216 maintains contact with the jaw set 220 and transfers the pulling force load of the tool onto the jaws 220. As the stroke continues, the mandrel 22 is pulled through the rivet sleeve 24, which remains held in place in the workpiece 234 by the nosepiece 232. As shown in FIG. 12, the flared end of the mandrel 22 expands the rivet sleeve 24 as it pulls through, causing the rivet sleeve 24 to form a "footprint" on the far side of the workpiece 234 that is larger than the hole in the workpiece 234.

Figure 13:
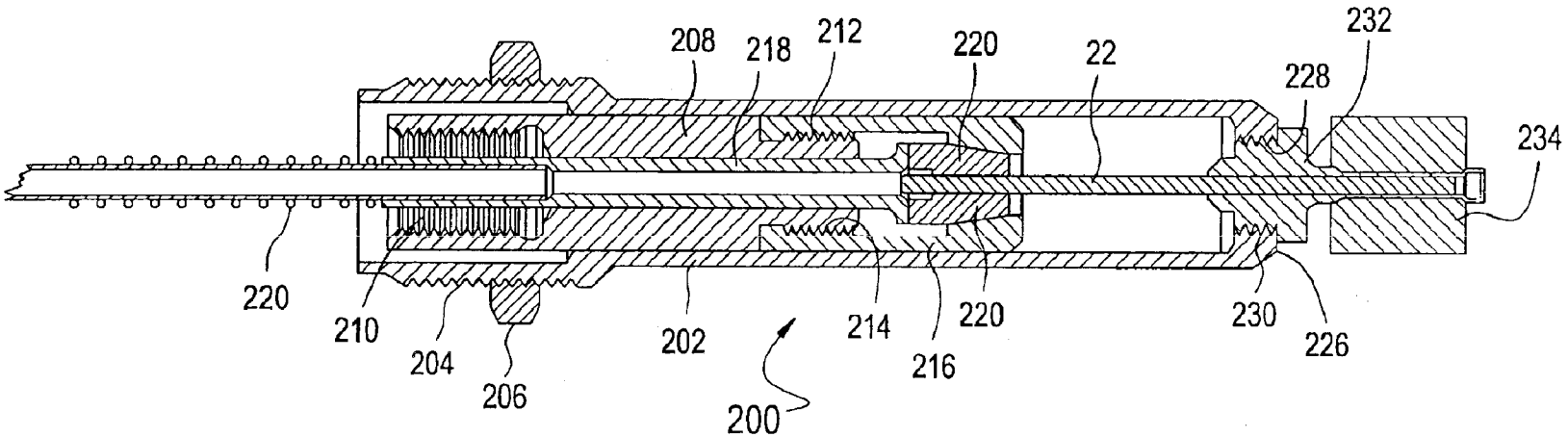
Figure 14:
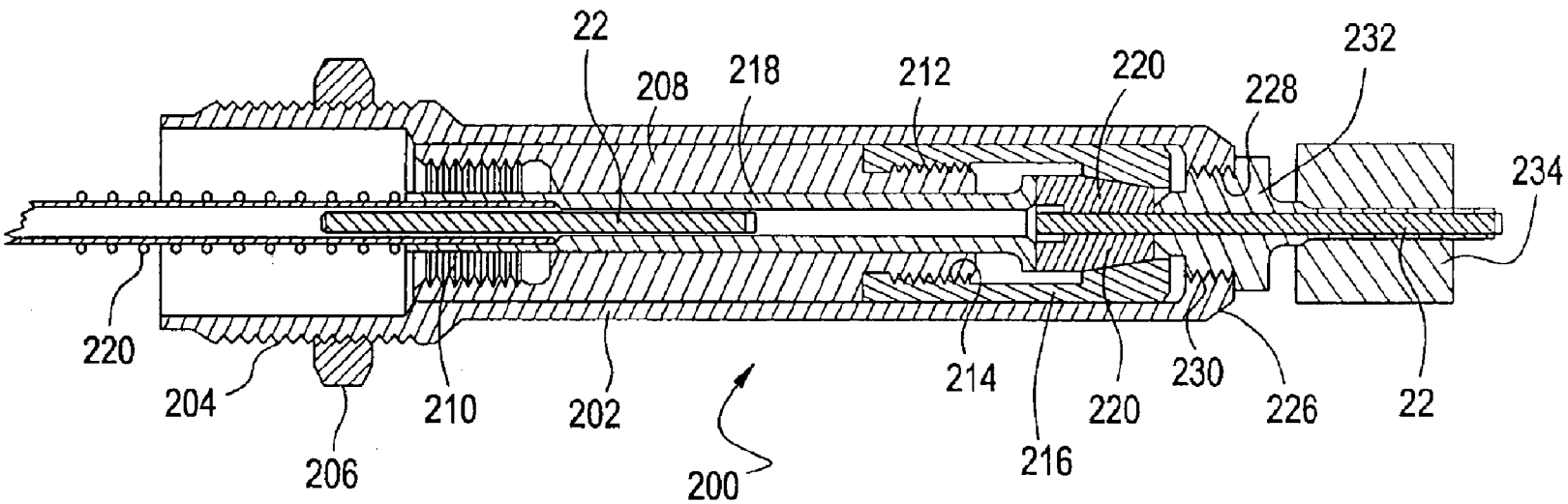

The mandrel 22 is eventually pulled completely through the rivet sleeve (see FIG. 13). As the mandrel 22 passes through the rivet sleeve 24, it also expands the sleeve 24 to fit tightly in the hole. The rivet 24 is installed, and the pulling head 200 is moved away from the workpiece 234 as the trigger 16 is released. The drawbar 208 and collet 216 move forward with the mandrel 22 held in the jaw set 220 until the jaw set 220 engages the nosepiece 232, which again expands the jaws 220 and releases the mandrel 22. At this point, another nut-plate rivet 24 can be inserted into the nosepiece 232. This rivet 24 pushes the mandrel 22 from the previous installation back through the jaw follower sub-assembly 218 (see FIG. 14). As the process is repeated, the mandrels 22 move through the tool 10 until they drop into the mandrel collector bag 26.

FIG. 15 illustrates a nut-plate riveter 10*a* very much like that which has been described above, except the riveter 10*a* includes three pistons 18, 20, 20*a* instead of two. As such, the riveter 10*a* has many of the same parts, but has a longer handle 12*a*, an extra bulkhead assembly 400 which includes a bulkhead 90*a*, retaining rings 402 and o-rings 404, an extra piston assembly which includes a piston 20*a* and o-rings 406, and an extra valve stem 80*a*. One having ordinary skill in the art would understand the structure and operation of the riveter 10*a* shown in FIG. 15 in light of the foregoing detailed description of riveter 10.

Regardless of how many pistons are employed, the fact that multiple pistons are used provides that the tool can be lightweight, yet provide the requisite pulling force on a mandrel to install a rivet. Further, the fact that the spent mandrel is pulled through the tool avoids problems and provides that the tool is reliable.

While embodiments of the present invention are shown and described, it is envisioned that those skilled in the art may devise various modifications of the present invention without departing from the spirit and scope of the disclosure.

What is claimed is:

1. A riveter comprising: a handle; a plurality of pistons disposed in the handle; cavities proximate the pistons for pressurizing the pistons; air supply passages in communication with the cavities for supplying air to the cavities to pressurize the pistons; and a piston rod threadably engaged with at least one of the pistons such that an air passage is provided at the engagement whereby air can pass between the piston rod and the piston, said piston rod providing at least one orifice for allowing passage of air between the piston rod and the cavities and having a longitudinal bore therethrough configured to receive a spent mandrel.

2. A riveter as recited in claim 1, wherein the plurality of pistons disposed in the handle comprises a front piston and a rear piston, wherein the piston rod extends through the front piston and is securably engaged with the rear piston.

3. A riveter as recited in claim 1, wherein the plurality of pistons disposed in the handle comprises three pistons.

4. A riveter as recited in claim 1, further comprising a deflector fitting disposed at an end of the nut-plate riveter.

5. A riveter as recited in claim 1, wherein the piston rod is cylindrical and includes orifices which are configured to allow the passage of air.

6. A riveter as recited in claim 1, further comprising a bulkhead which engages an exterior surface of one of the pistons and contacts a wall in the handle.

7. A riveter as recited in claim 1, further comprising a trigger on the handle for actuating the nut-plate riveter.

8. A riveter as recited in claim 1, further comprising a front cap sub-assembly comprising a front cap and a bumper member disposed in the front cap, wherein an end of said handle is configured to receive the front cap sub-assembly.

9. A riveter as recited in claim 8, wherein the front cap threadably engages the end of the handle.

10. A riveter as recited in claim 1, further comprising a pulling head which is engaged with said piston rod.

11. A riveter as recited in claim 10, wherein said pulling head comprises a nose fitting, a sleeve and a drawbar, said sleeve being threadably engaged with said nose fitting, said drawbar being disposed in said sleeve and threadably engaged with said piston rod.

12. A riveter as recited in claim 11, wherein said pulling head further comprises a jaw follower sub-assembly and a jaw set, said jaw follower sub-assembly being disposed in the drawbar and contactably engaged with said jaw set.

13. A riveter as recited in claim 12, wherein said pulling head further comprises a follower spring, said jaw follower sub-assembly engaged with said follower spring, said follower spring being engaged with an interior surface of the piston rod.

* * * * *